US006325601B2

(12) United States Patent
Wu

(10) Patent No.: US 6,325,601 B2
(45) Date of Patent: Dec. 4, 2001

(54) MANUAL AIR PUMP HAVING SELECTABLE HIGH PRESSURE AND HIGH VOLUME MODES

(76) Inventor: Scott Wu, No. 2, Lane 187, Hsi Hu Road, Ta Li City, Taichung Hsien (TW)

( * ) Notice: Subject to any disclaimer, the term of this patent is extended or adjusted under 35 U.S.C. 154(b) by 0 days.

(21) Appl. No.: 09/767,170

(22) Filed: Jan. 22, 2001

Related U.S. Application Data

(63) Continuation-in-part of application No. 09/547,656, filed on Apr. 12, 2000, now Pat. No. 6,257,849.

(51) Int. Cl.[7] ..... F04B 19/02; F04B 39/10; F15B 15/26; F01B 7/20

(52) U.S. Cl. ..... 417/469; 417/559; 417/569; 92/15; 92/52

(58) Field of Search ..... 417/469, 559, 417/569; 60/479; 92/15, 52, 51

(56) References Cited

U.S. PATENT DOCUMENTS

| | | | | |
|---|---|---|---|---|
| 624,917 | * | 5/1899 | Feeny | 417/468 |
| 670,811 | * | 3/1901 | Phelps | 92/52 |
| 799,786 | | 9/1905 | Freel . | |
| 1,474,204 | * | 11/1923 | MacGregor | 417/512 |
| 1,522,370 | | 1/1925 | Jenney . | |
| 2,450,295 | | 9/1948 | Parker et al. . | |
| 3,452,647 | * | 7/1969 | Herrell | 92/23 |
| 4,508,490 | | 4/1985 | Ramirez et al. . | |
| 5,443,370 | | 8/1995 | Wang . | |
| 5,655,890 | * | 8/1997 | Liao | 417/234 |
| 5,779,457 | * | 7/1998 | Chuang et al. | 417/467 |
| 5,873,705 | * | 2/1999 | Chen | 417/259 |
| 6,257,849 | | 11/2000 | Wu . | |

* cited by examiner

*Primary Examiner*—Timothy S. Thorpe
*Assistant Examiner*—Timothy P. Solak
(74) *Attorney, Agent, or Firm*—Alan Kamrath; Rider, Bennett, Egan & Arundel, LLP

(57) ABSTRACT

A manual air pump includes an outer cylinder comprising a chamber therein, a head provided to an end of the outer cylinder, the head including an outlet passage communicated with the chamber for supplying air to an object to be inflated, and an inner cylinder reciprocatingly mounted in the outer cylinder. An outer piston is attached to an end of the inner cylinder to move therewith and includes a passage for communicating a longitudinal bore of the inner cylinder with one of the outlet passage of the head and the chamber of the outer cylinder. A piston rod is reciprocatingly mounted in longitudinal bore of the inner cylinder and an inner piston is attached to an end of the piston rod to move therewith. A handle is secured to the other end of the piston rod to move therewith. The inner cylinder is rotatable relative to the outer cylinder. When the inner cylinder is in a first angular position relative to the outer cylinder for high-volume inflation, the inner cylinder is reciprocatingly and longitudinally movable relative to the outer cylinder. When the inner cylinder is in a second angular position relative to the outer cylinder for high-pressure inflation, the inner cylinder is immobile in a longitudinal direction relative to the outer cylinder.

13 Claims, 9 Drawing Sheets

MANUAL AIR PUMP HAVING SELECTABLE HIGH PRESSURE AND HIGH VOLUME MODES

CROSS REFERENCE TO RELATED APPLICATION

This is a continuation-in-part application of U.S. patent application Ser. No. 09/547,656 filed on Apr. 12, 2000, now U.S. Pat. No. 6,257,849.

BACKGROUND OF THE INVENTION

1. Field of the Invention

The present invention relates to a manual air pump for inflating, e.g., bicycle tires, and more particularly to a dual-mode manual air pump that may in one mode provide a very high volume of air per stroke and in another mode provide less volume of air at high pressure.

2. Description of the Related Art

Bicycle pumps include two typical types: 1) big bore for high volume per stroke and low pressure for rapid inflation, yet high pressure operation is difficult to achieve; and 2) small bore for low volume per stroke and high pressure for inflating bicycle tires to high pressure. U.S. Pat. No. 5,443,370 issued to Wang on Aug. 22, 1995 proposes a two-cylinder manual air pump having selectable high volume and high pressure modes, wherein the pump in one mode provides a very high volume of air per pump stroke and in another mode provides less volume per stroke but enables the user to inflate to higher pressures. Nevertheless, manufacture, assembly, and use of such manual air pumps are complicated and troublesome. The structure in the cylinders for air passage is too complicated. In addition, the thinner piston rod might be broken during the output stroke, as the travel for the thinner piston rod is relatively long and as the piston on the thinner piston rod encounters much higher pressure when the piston approaches the inner end of the outer cylinder. Namely, the thinner piston rod tends to be broken and requires a larger force to push it. Further, the manual air pump is too long when in a fully extended status. Further, the manual air pump generates noise during inflation.

Applicant's U.S. Pat. No. 6,257,849 discloses a manual air pump to solve the above problems. The present invention is intended to provide an improved design in this regard.

Summary of the Invention

A manual air pump in accordance with the present invention comprises:

an outer cylinder comprising a chamber therein and including a first end and a second end;

a head provided to the second end of the outer cylinder, the head including an outlet passage communicated with the chamber for supplying air to an object to be inflated;

an inner cylinder reciprocatingly mounted in the outer cylinder and including a longitudinal bore, the inner cylinder including a first end distal to the head and a second end adjacent to the head, an outer piston being attached to the second end of the inner cylinder to move therewith, the outer piston including a passage for communicating the longitudinal bore of the inner cylinder with one of the outlet passage of the head and the chamber of the outer cylinder;

a piston rod reciprocatingly mounted in longitudinal bore of the inner cylinder and having a first end and a second end, an inner piston being attached to the second end of the piston rod to move therewith; and a handle secured to the first end of the piston rod to move therewith, wherein the inner cylinder is rotatable relative to the outer cylinder, and when the inner cylinder is in a first angular position relative to the outer cylinder for high-volume inflation, the inner cylinder is reciprocatingly and longitudinally movable relative to the outer cylinder; and wherein when the inner cylinder is in a second angular position relative to the outer cylinder for high-pressure inflation, the inner cylinder is immobile in a longitudinal direction relative to the outer cylinder.

The first end of the outer cylinder has a tubular stop member fixed thereon. The inner cylinder extends through the tubular stop member and includes a first stop on an outer periphery thereof and adjacent to the first end thereof. The tubular stop member includes a second stop that defines a receiving space therein. When the inner cylinder is in the first angular position relative to the outer cylinder for high-volume inflation, the first stop of the inner cylinder is not received in the receiving space such that longitudinal outward and inward movement of the inner cylinder relative to the outer cylinder is allowed. When the inner cylinder is in the second angular position relative to the outer cylinder for high-pressure inflation, the first stop of the inner cylinder is received in the receiving space such that the longitudinal outward movement of the inner cylinder relative to the outer cylinder is prevented by the second stop.

The outer periphery of the inner cylinder further includes a longitudinal guide strip formed thereon. A gap is defined between the longitudinal guide strip and the first stop of the inner cylinder. The stop member includes a longitudinal recessed portion in an inner periphery thereof. Rotational movement of the inner cylinder relative to the outer cylinder is allowed only when the stop member is located in the gap. The stop member is located in the gap when the inner cylinder is moved to a predetermined longitudinal position relative to the outer cylinder. In an embodiment of the invention, the stop member is located in the gap when the outer piston on the inner cylinder is in its innermost position relative to the outer cylinder.

The longitudinal guide strip of the inner cylinder is guided by the longitudinal recessed portion of the stop member during longitudinal movement of the inner cylinder relative to the outer cylinder, thereby preventing relative rotation of the inner cylinder relative to the outer cylinder during high-volume inflation.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
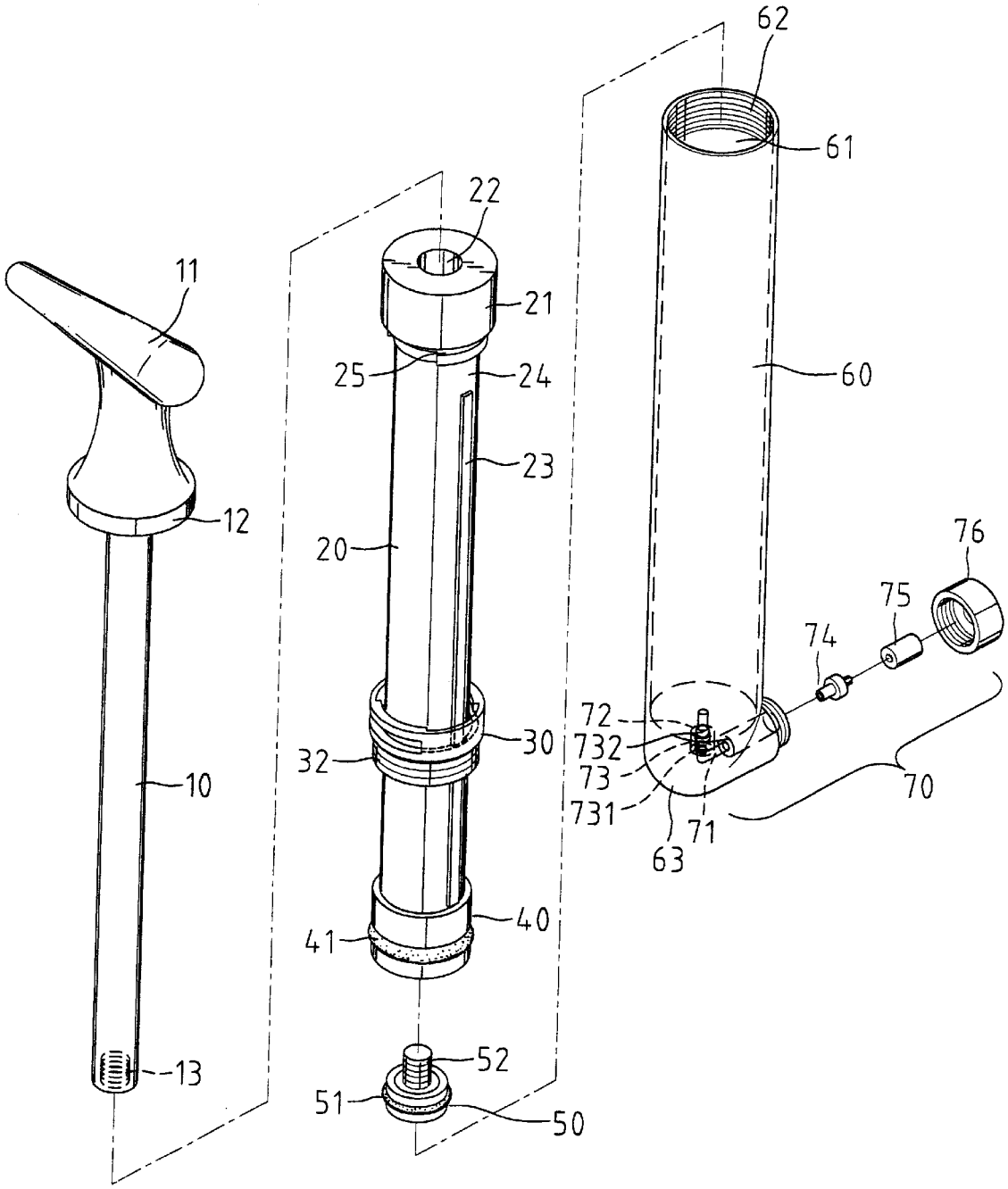
FIG. 1 is an exploded perspective view of a manual air pump in accordance with the present invention.
Figure 2:
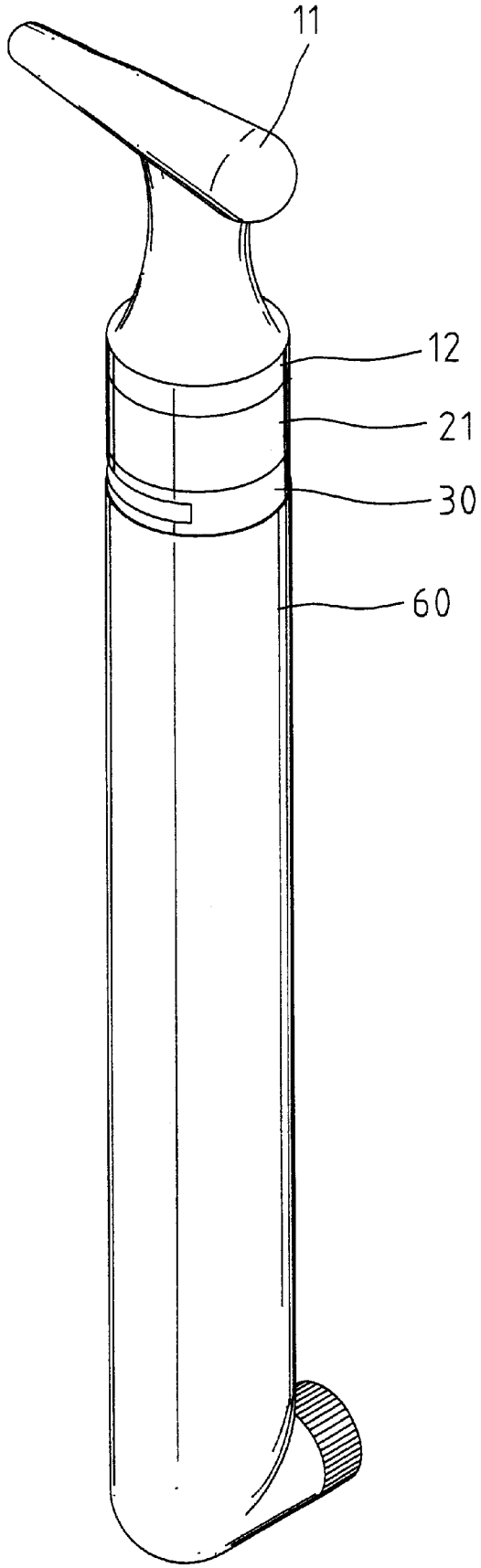
FIG. 2 is a perspective view of the manual air pump in FIG. 1.
Figure 5:
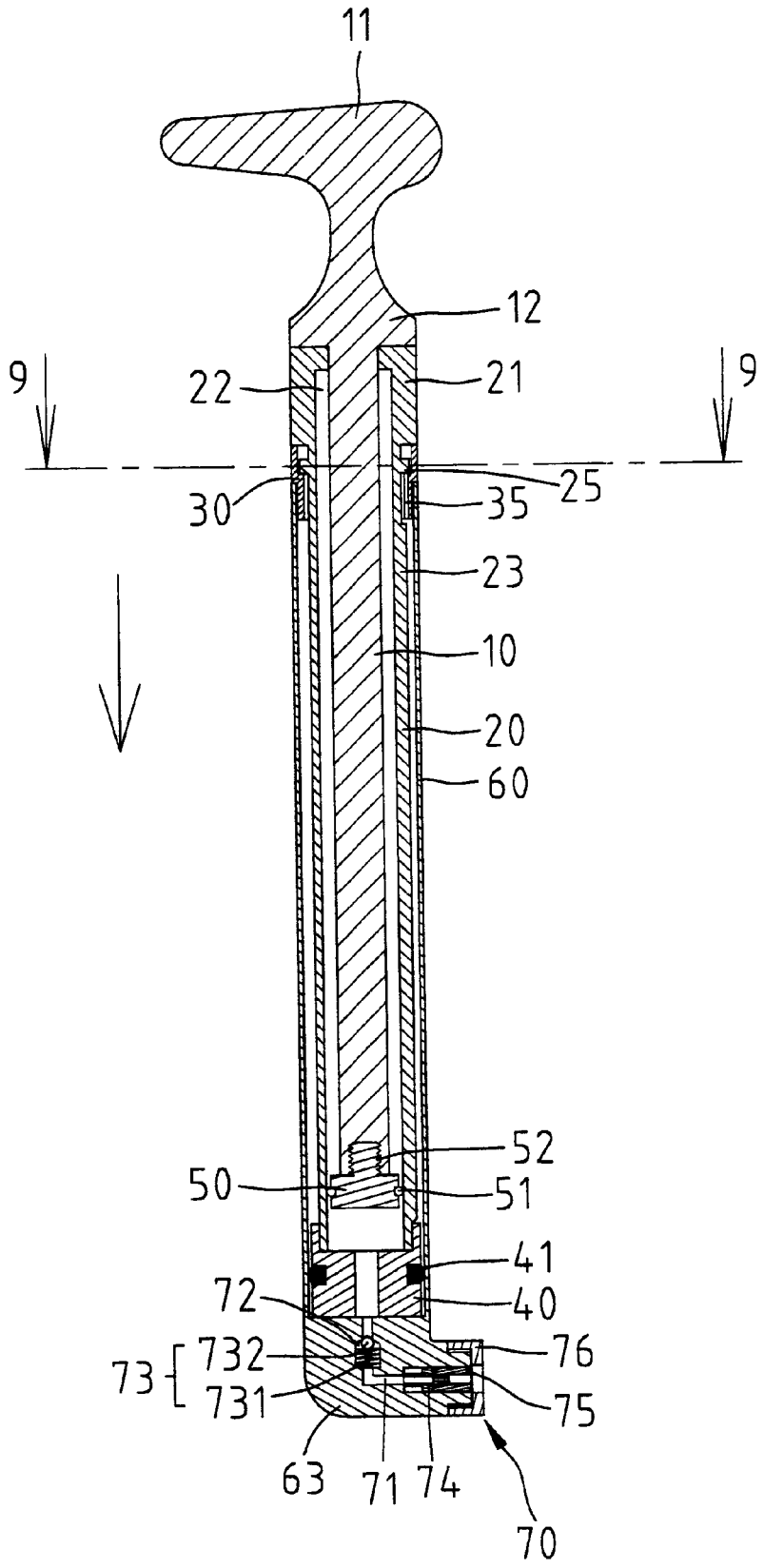
FIG. 5 is a longitudinal sectional view of the manual air pump in FIG. 1, wherein the manual air pump is in an inward stroke for high-volume pumping.

Referring to FIGS. 1, 2, and 5, a manual air pump in accordance with the present invention generally comprises an outer cylinder 60 including a chamber 61 therein. An inner threading 62 is provided on a first end of the outer cylinder 60 and a head 63 is formed on the other end of the outer cylinder 60. The head 63 includes an outlet passage 71 communicated with the chamber 61 for supplying air to an object to be inflated under control of an inflation valve means 70. In this embodiment, a nozzle 74 and a nozzle plug 75 are mounted in the outlet passage 71, and an end cap 76 is provided to secure the nozzle 74 and nozzle plug 75 in place. A one-way valve 73 (including an elastic member 731 and a ball 732) is mounted in an enlarged section 72 of the outlet passage 71 such that air is only flowable from the chamber 61 to the outlet passage 71.

Figure 4:
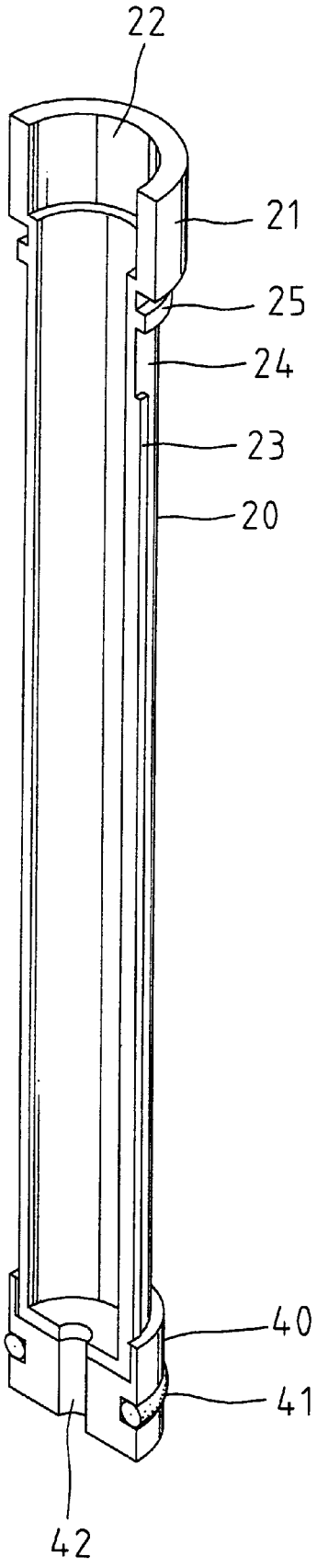
FIG. 4 is a perspective view, partly cutaway, of an inner cylinder of the manual air pump in FIG. 1.
Figure 6:
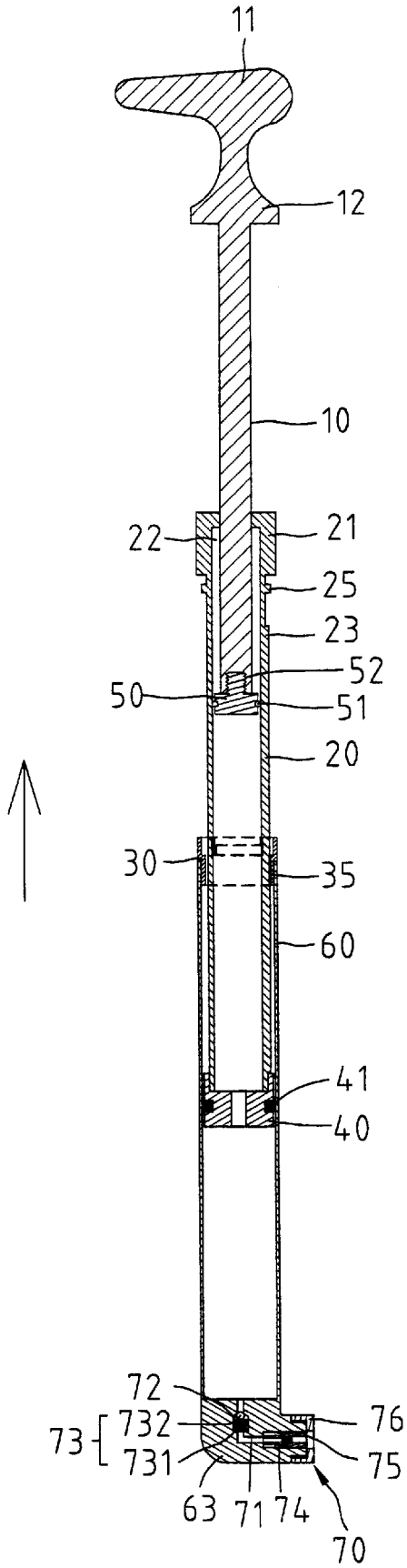
FIG. 6 is a sectional view similar to FIG. 5, wherein the manual air pump is in an outward stroke for high-volume pumping.
Figure 7:
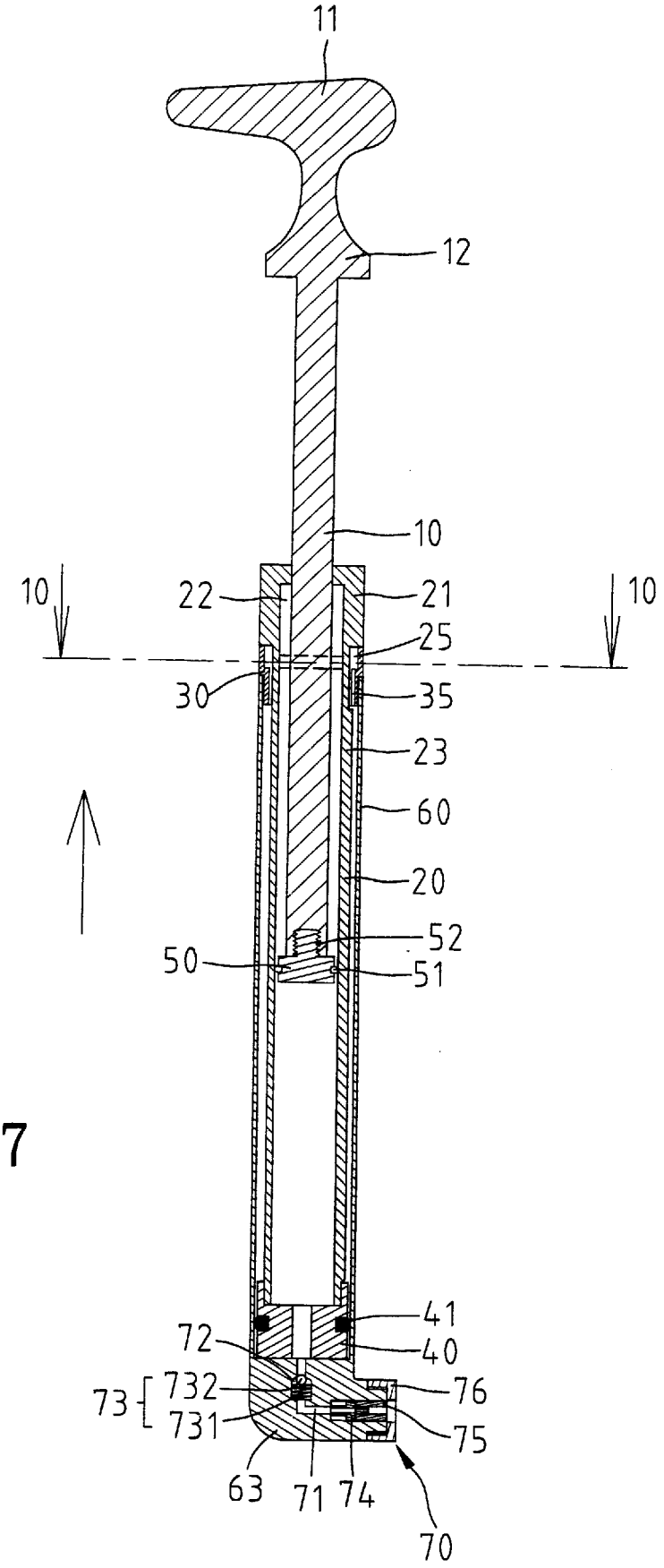
FIG. 7 is a sectional view similar to FIG. 5, wherein the manual air pump is in an outward stroke for high-pressure pumping.
Figure 8:
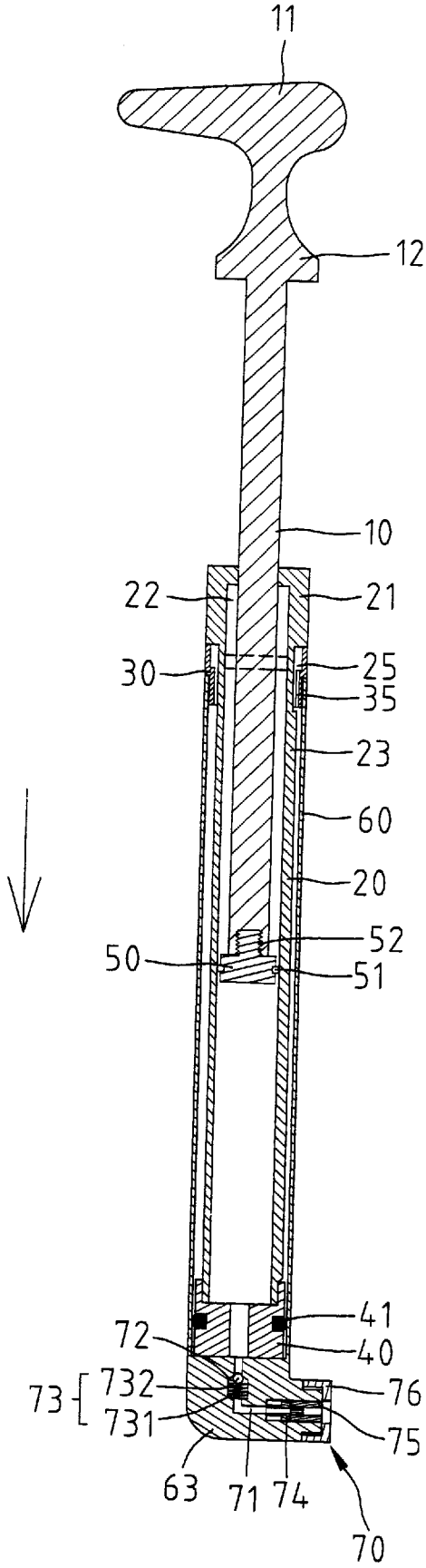
FIG. 8 is a sectional view similar to FIG. 7, wherein the manual air pump is in an inward stroke for high-pressure pumping.

The manual air pump further includes an inner cylinder 20 that is slidably received in the outer cylinder 60. As illustrated in FIGS. 2 and 4, the inner cylinder 20 includes a longitudinal bore 22. The inner cylinder 20 includes an enlarged first end 21 and at least one stop 25 formed on an outer periphery of the inner cylinder 20 and adjacent to the enlarged first end 21. In this embodiment, there are two diametrically disposed stops 25. An outer piston 40 is engaged on a second end of the inner cylinder 20 and includes a passage 42 that is intercommunicated between the longitudinal bore 22 and the outlet passage 71 (FIG. 6) or the chamber 61 of the outer cylinder 60 (FIGS. 7 and 8). An O-ring 41 is mounted around the outer piston 40 to provide a sealing effect between the outer piston 40 and the inner periphery of the chamber 61 of the outer cylinder 60. An outer longitudinal guide strip 23 is formed on the outer periphery of the inner cylinder 20 and a gap 24 is defined between an end of the guide strip 23 and the stop 25 (FIG. 4).

A piston rod 10 is reciprocally mounted in the inner cylinder 20 and includes a disc 12 on a first end thereof. A handle 11 extends outward from the disc 12 and beyond the outer cylinder 60 for manual operation. A screw hole 13 is defined in an end wall of a second end of the piston rod 10. An inner piston 50 includes a stud 52 for engaging with the screw hole 13 of the piston rod 10. An O-ring 51 is mounted around the inner piston 50 to provide a sealing effect between the inner piston 50 and the inner periphery of the longitudinal bore 22 of the inner cylinder 20. It is noted that the outer piston 40 has an area wider than that of the inner piston 50.

Figure 3:
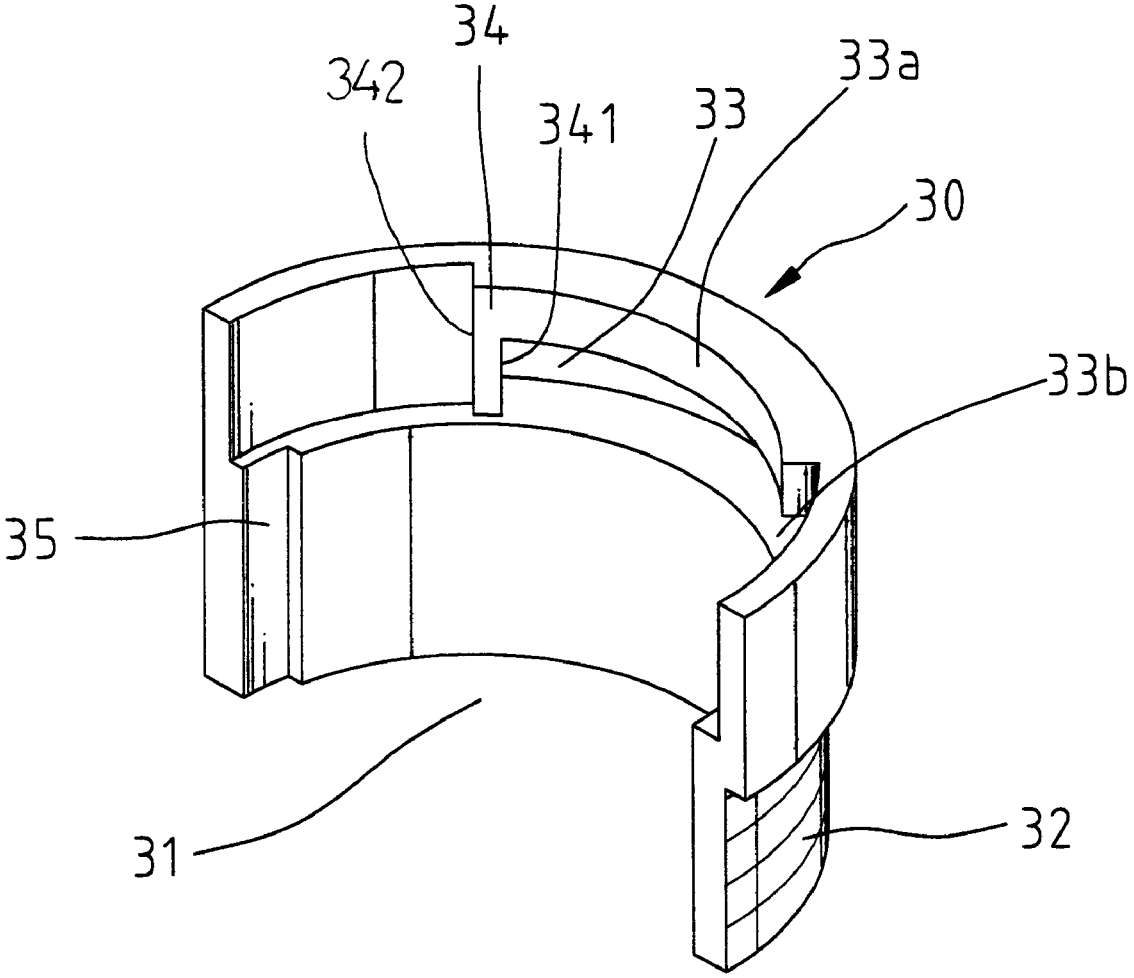
FIG. 3 is a perspective view, partly cutaway, of a stop member in FIG. 1.

Referring to FIGS. 2, 3, and 5, a substantially tubular stop member 30 includes an outer threading 32 on a lower end thereof for threading connection with the inner threading 62 of the outer cylinder 60. The stop member 30 further includes a longitudinal hole 31 with a longitudinal recessed portion 35 defined in an inner periphery thereof. The piston rod 10 extends through the longitudinal hole 31 of the stop member 30. At least one sector-like stop 33*a* is formed on the inner periphery defining the longitudinal hole 31. In this embodiment, there are two diametrically disposed sector-like stops 33*a*. As illustrated in FIG. 3, the stop 33*a* projects radially inward from the inner periphery defining the longitudinal hole 31 and defines a receiving space 33 thereunder and a free space 33*b* adjacent to the stop 33*a* . The receiving space 33 is defined by an end wall 34 that has a first side 341 and a second side 342.

Figure 9:
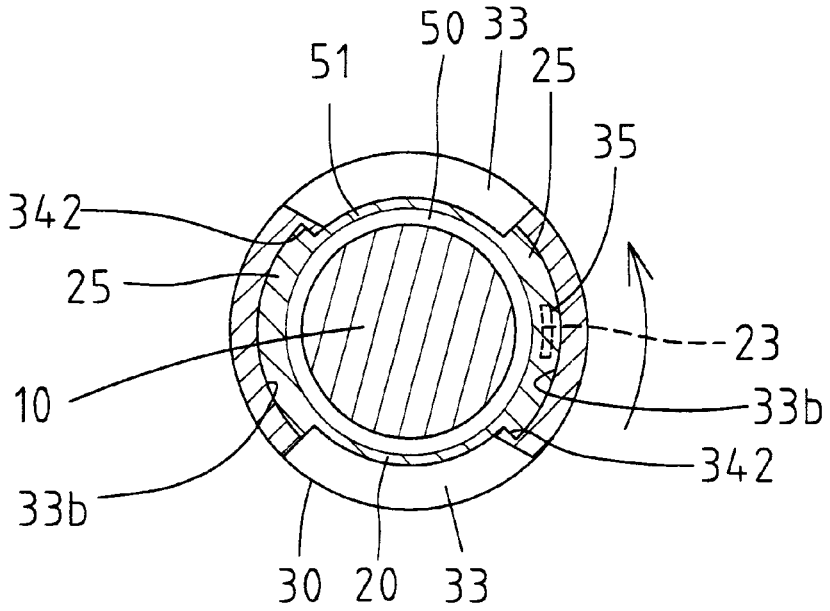
FIG. 9 is a sectional view taken along line 9—9 in FIG. 5.
Figure 10:
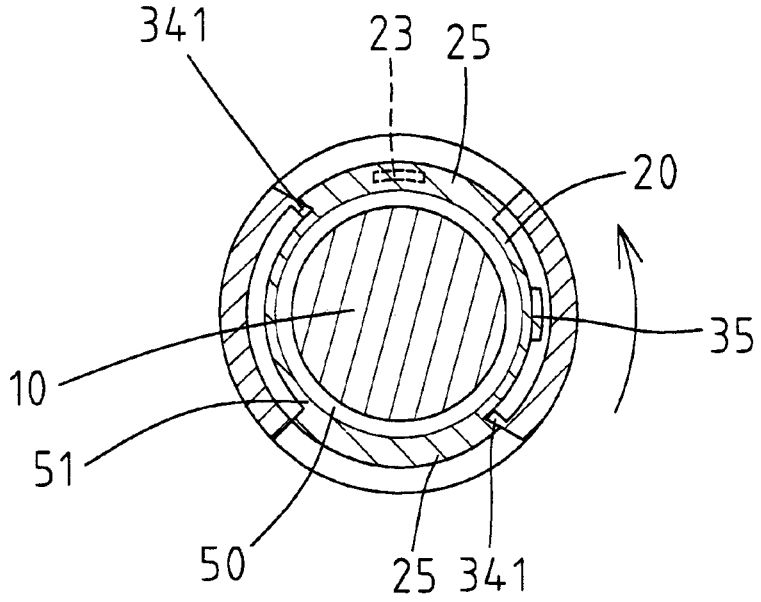
FIG. 10 is a sectional view taken along line 10—10 in FIG. 7.

Referring to FIGS. 5 and 9, when the inner cylinder 20 is in a first angular position relative to the stop member 30 shown in FIG. 9, each stop 25 on the inner cylinder 20 is received in an associated free space 33*b* in the stop member 30. It is noted that the longitudinal guide strip 23 of the inner cylinder 20 extends through the longitudinal recessed portion 35 of the stop member 30. The pump is in a state for high-volume pumping. In an outward stroke for high-volume pumping (FIG. 6), the user may pull the handle 11 outward until the inner piston 50 reaches its outermost position. The user may further pull the handle 11 outward which will cause the piston rod 10 and the inner cylinder 20 to move outward together until the outer piston 40 reaches its outermost position. Next, the user may push the handle 11 downward until the inner piston 50 reaches its innermost position where the disc 12 of the handle 11 abuts against the enlarged end 21 of the inner cylinder 20. The user may further push the handle 11 inward which will cause the piston rod 10 and the inner cylinder 20 to move inward together until the outer piston 40 reaches its innermost position. Thus, a stroke of high-volume inflation is achieved, as the air inside the inner cylinder 20 and the outer cylinder 60 are pumped into the object to be inflated via the inflation valve means 70. It is noted that rotational movement of the inner cylinder 20 relative to the outer cylinder 60 and the stop member 30 is avoided, since the longitudinal guide strip 23 of the cylinder 20 extends through the longitudinal recessed portion 35 of the stop member 30. This provides stable reciprocating longitudinal movement of the inner cylinder 20 relative to the outer cylinder 60.

When high-pressure inflation is required, the user may push the handle 11 to make the outer piston 40 reach its innermost position and then turns the inner cylinder 20 relative to the outer cylinder 60 until each stop 25 of the inner cylinder 20 is received in an associated receiving space 33. Thus, outward movement of the inner cylinder 20 is not allowed, as the stops 25 of the cylinder 20 will be stopped by the stops 33*a* on the stop member 30. In an outward stroke for high-pressure pumping (FIG. 7), the user may pull the handle 11 outward until the inner piston 50 reaches its outermost position. Next, the user may push the handle 11 downward until the inner piston 50 reaches its innermost position. Thus, a stroke of high pressure inflation is achieved, as only the air inside the inner cylinder 20 is pumped into the object to be inflated via the inflation valve means 70.

It is appreciated that, in this embodiment, the switching from the high-pressure mode to the high-volume mode by mean of turning the inner cylinder 20 is only allowed when the outer piston 40 on the inner cylinder 20 reaches its innermost position where the stop member 30 fixed on the outer cylinder 60 is located in the gap 24 between the stop 25 and the longitudinal guide strip 23. Namely, relative rotation between the inner cylinder 20 and the stop member 30 is allowed only when the stop member 30 fixed on the outer cylinder 60 is located in the gap 24 between the stop 25 and the longitudinal guide strip 23. Thus, the user may turn the inner cylinder 20 relative to the stop member 30 until the stops 25 of the inner cylinder 20 are moved out of the receiving spaces 33 into the free spaces 33*b* shown in FIG. 9. The user may ascertain complete disengagement of the stops 25 of the inner cylinder 20 from the receiving spaces 33 by feeling that an end edge of each stop 25 is stopped by the first side 341 of an associated end wall 34. Similarly, the user may ascertain complete engagement of the stops 25 in the inner cylinder 20 in the receiving spaces 33 by feeling that the other end edge of each stop 25 is stopped by the second side 342 of the associated end wall 34.

According to the above description, a reliable dual-mode manual air pump is provided, and operation therefor is simple and easy. Namely, only rotation of the inner cylinder 20 is required for switching between high-pressure inflation and high-volume inflation. Potential breakage of the thinner piston rod encountered during the use of conventional two-cylinder manual hand air pump is avoided. The overall structure is compact and simple.

Although the invention has been explained in relation to its preferred embodiment, it is to be understood that many other possible modifications and variations can be made without departing from the spirit and scope of the invention as hereinafter claimed.

What is claimed is:

1. A manual air pump comprising:

an outer cylinder comprising a chamber therein and including a first end and a second end;

a head provided to the second end of the outer cylinder, the head including an outlet passage communicated with the chamber for supplying air to an object to be inflated;

an inner cylinder reciprocatingly mounted in the outer cylinder and including a longitudinal bore, the inner cylinder including a first end distal to the head and a second end adjacent to the head, an outer piston being attached to the second end of the inner cylinder to move therewith, the outer piston including a passage for communicating the longitudinal bore of the inner cylinder with one of the outlet passage of the head and the chamber of the outer cylinder;

a longitudinal guide strip formed on the outer periphery of the inner cylinder and defining a gap;

a recessed portion fixed relative to the outer cylinder and for slideable receipt of the longitudinal guide strip;

a piston rod reciprocatingly mounted in the longitudinal bore of the inner cylinder and having a first end and a second end, an inner piston being attached to the second end of the piston rod to move therewith; and a handle secured to the first end of the piston rod to move therewith;

wherein the inner cylinder is rotatable relative to the outer cylinder when the recessed portion is within the gap and the inner cylinder is reciprocally and longitudinally movable relative to the outer cylinder and rotational movement of the inner cylinder relative to the outer cylinder is avoided when the longitudinal guide strip is received in the recessed portion.

2. The manual air pump as claimed in claim 1, wherein the second end of the piston rod includes a screw hole and wherein the inner piston includes a stud for engaging with the screw hole of the piston rod.

3. The manual air pump as claimed in claim 1, further comprising a disc formed on the first end of the piston rod for engaging with the first end of the inner cylinder for highvolume inflation.

4. The manual air pump as claimed in claim 1, wherein the outlet passage of the outer cylinder includes a nozzle and a nozzle plug mounted therein and an end cap provided to secure the nozzle and nozzle plug in place, a one-way valve being mounted in the outlet passage such that air is only flowable from the chamber of the outer cylinder to the outlet passage.

5. The manual air pump as claimed in claim 1, wherein the inner cylinder is rotatable relative to the outer cylinder between first and second angular positions when the recessed portion is within the gap, wherein the piston is reciprocal in the inner cylinder in turn reciprocal in the outer cylinder for high volume inflation in the first angular position and wherein the piston is reciprocal in the inner cylinder longitudinally immobile relative to the outer cylinder for high-pressure inflation in the second angular position.

6. The manual air pump as claimed in claim 1, further comprising: a first member formed on the outer cylinder; and a second member formed on the inner cylinder, with the second member being removably engageable with the first member when the recessed portion is within the gap, with the inner cylinder being longitudinally immobile relative to the outer cylinder when the first and second members are engaged and being longitudinally mobile relative to the outer cylinder when the first and second members are disengaged.

7. The manual air pump as claimed in claim 6, wherein the inner cylinder is rotatable relative to the outer cylinder between first and second angular positions, with the first and second members being disengaged in the first angular position and being engaged in the second angular position.

8. The manual air pump as claimed in claim 7, wherein the piston is reciprocal in the inner cylinder in turn reciprocal in the outer cylinder for high-volume inflation when the first and second members are disengaged and wherein the piston is reciprocal in the inner cylinder longitudinally immobile relative to the outer cylinder for high-pressure inflation when the first and second members are engaged.

9. The manual air pump as claimed in claim 8, wherein the first end of the outer cylinder has the first member in the form of a tubular stop member fixed thereon, the inner cylinder extending through the tubular stop member and including the second member in the form of a first stop on an outer periphery thereof and adjacent to the first end thereof, the tubular stop member including a second stop that defines a receiving space therein;

wherein when the inner cylinder is in the first angular position relative to the outer cylinder for high-volume inflation, the first stop of the inner cylinder is not received in the receiving space such that longitudinal outward and inward movement of the inner cylinder relative to the outer cylinder is allowed; and wherein when the inner cylinder is in the second angular position relative to the outer cylinder for high-pressure inflation, the first stop of the inner cylinder is received in the receiving space such that the longitudinal outward movement of the inner cylinder relative to the outer cylinder is prevented by the second stop.

10. The manual air pump as claimed in claim 9, wherein the gap is defined between the longitudinal guide strip and the first stop of the inner cylinder, the stop member including the recessed portion in an inner periphery thereof, wherein rotational movement of the inner cylinder relative to the outer cylinder is allowed only when the stop member is locate in the gap.

11. The manual air pump as claimed in claim 10, wherein the stop member is located in the gap when the inner cylinder is moved to a predetermined longitudinal position relative to the outer cylinder.

12. The manual air pump as claimed in claim 10, wherein the stop member is located in the gap when the outer piston on the inner cylinder is in its innermost position relative to the outer cylinder.

13. The manual air pump as claimed in claim 10, wherein the longitudinal guide strip of the inner cylinder is guided by the recessed portion of the stop member during longitudinal movement of the inner cylinder relative to the outer cylinder, thereby preventing relative rotation of the inner cylinder relative to the outer cylinder during high-volume inflation.

* * * * *